US006703553B2

(12) United States Patent
Bersis et al.

(10) Patent No.: US 6,703,553 B2
(45) Date of Patent: Mar. 9, 2004

(54) CHORDED MUSICAL INSTRUMENT

(76) Inventors: Constandino Bersis, 120 High St., Closter, NJ (US) 07624; Christos Hatzoudis, 306 Main St., Ridgefield Park, NJ (US) 07660

( * ) Notice: Subject to any disclaimer, the term of this patent is extended or adjusted under 35 U.S.C. 154(b) by 0 days.

(21) Appl. No.: 09/972,731

(22) Filed: Oct. 5, 2001

(65) Prior Publication Data

US 2002/0096038 A1 Jul. 25, 2002

Related U.S. Application Data

(60) Provisional application No. 60/238,788, filed on Oct. 6, 2000.

(51) Int. Cl.[7] ..... G10H 3/18
(52) U.S. Cl. ..... 84/731
(58) Field of Search ..... 84/723, 726, 730, 84/731

(56) References Cited

U.S. PATENT DOCUMENTS

| | | | | | |
|---|---|---|---|---|---|
| 4,228,715 | A | * | 10/1980 | Nourney | 84/734 |
| 4,567,805 | A | * | 2/1986 | Clevinger | 84/731 |
| 4,860,625 | A | * | 8/1989 | Mathews | 84/731 |
| 4,867,027 | A | * | 9/1989 | Barbera | 84/731 |
| 5,247,132 | A | * | 9/1993 | Henderson | 84/735 |
| 5,539,147 | A | * | 7/1996 | Hoshino | 84/723 |
| 5,591,931 | A | * | 1/1997 | Dame | 84/726 |
| 5,637,818 | A | * | 6/1997 | Fishman et al. | 84/313 |
| 5,945,622 | A | * | 8/1999 | Yamada | 84/731 |
| 6,191,350 | B1 | * | 2/2001 | Okulov et al. | 84/646 |

* cited by examiner

*Primary Examiner*—Jeffrey Donels

(57) ABSTRACT

A chorded musical instrument comprising an electronic signal interface with analog and MIDI signal outputs. In a dual-string configuration, the instrument includes piezoelectric pickups arranged in pairs. The pickups are coupled to inputs of a signal processing device, with each input being coupled to one or more pickups. The signal processing device provides both analog and MIDI signal outputs.

12 Claims, 7 Drawing Sheets

CHORDED MUSICAL INSTRUMENT

RELATED APPLICATIONS

The present application is based on U.S. Provisional Patent Application No. 60/238,788, filed Oct. 6, 2000, entitled ELECTRONIC INTERFACE FOR A STRINGED INSTRUMENT, and incorporated herein by reference in its entirety.

FIELD OF THE INVENTION

The present invention relates to stringed musical instruments, particularly to such instruments having an electronic interface.

BACKGROUND INFORMATION

Musical instruments having electronic signal interfaces are well known. One such interface is an analog signal interface, which provides a faithful analog signal representation of the sound generated by the instrument. Another commonly used interface of more recent origin is the Musical Instrument Digital Interface (MIDI). The MIDI interface provides for the exchange of digital signals in accordance with a standardized protocol. MIDI interfaces are common on musical instruments such as keyboards and six string guitars.

Other musical instruments, however, such as double stringed instruments, have not been provided with MIDI interfaces.

SUMMARY OF THE INVENTION

In accordance with an exemplary embodiment of the present invention, a stringed instrument is provided incorporating several novel aspects.

In a first aspect, the present invention provides a novel bridge which allows the arrangement thereon of piezoelectric pickups in closely spaced groups, such as pairs.

In a further aspect, the present invention provides a novel piezoelectric pickup which can be arranged collinearly with the chord with which it makes contact. This allows for a compact arrangement with closely spaced strings.

In yet a further aspect, the pickups can be coupled to a signal processing device in one of several arrangements that allow for the generation of MIDI and analog signal representations of the string vibrations. In accordance with the present invention, the number of strings and pickups can exceed the number of signal inputs of the signal processing device.

In a further embodiment, the present invention provides a double stringed instrument having octave tuning with a MIDI interface. The present invention can be applied to any double stringed instruments that have the same tuning in unison or in octave, such as the bouzouki, the mandolin, the twelve string guitar, the oud and the saz.

DETAILED DESCRIPTION

Figure 5:
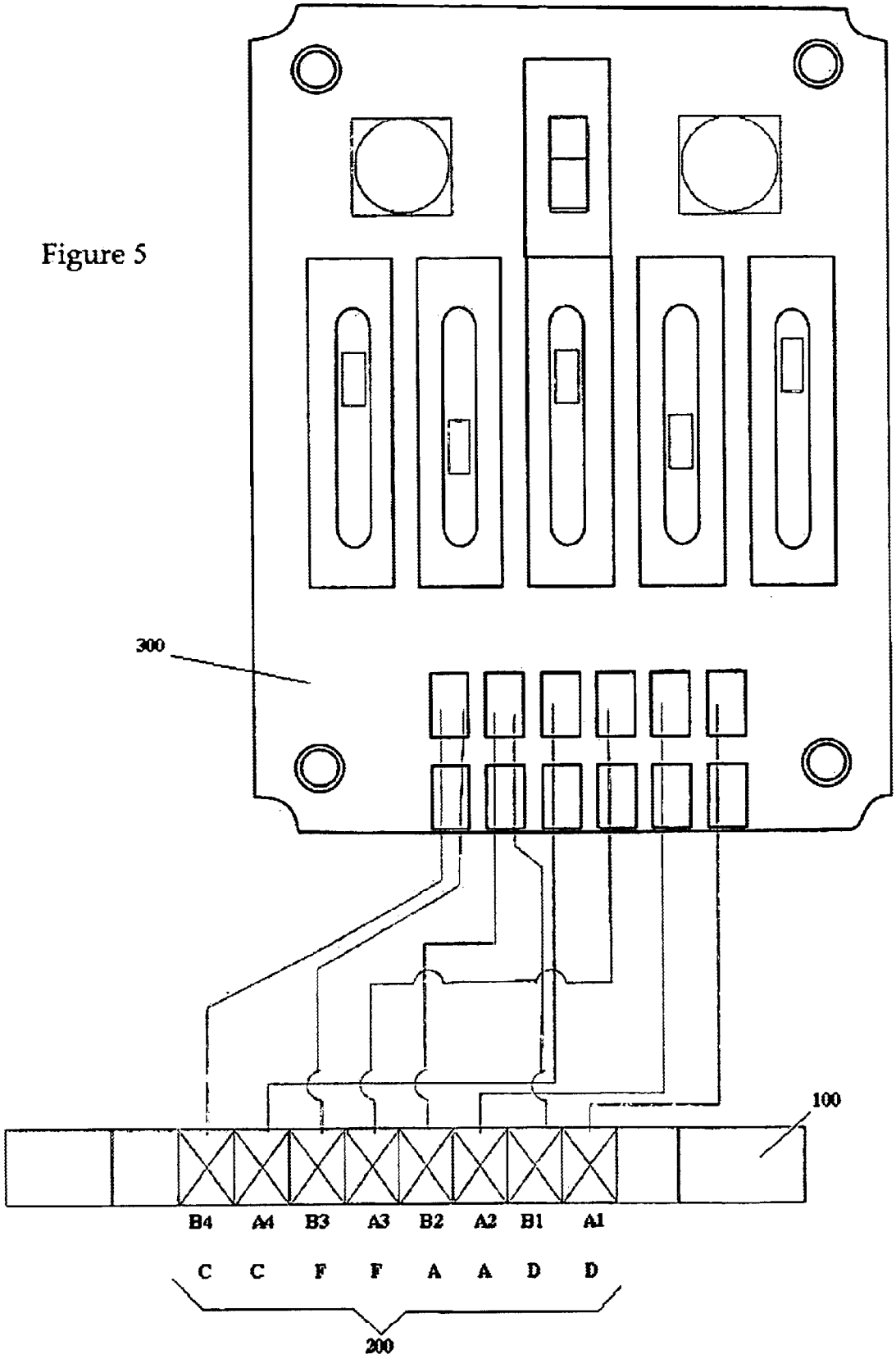
FIG. 5 shows an exemplary connection scheme of piezoelectric pickups to inputs of the signal processing device, in accordance with the present invention.
Figure 6:
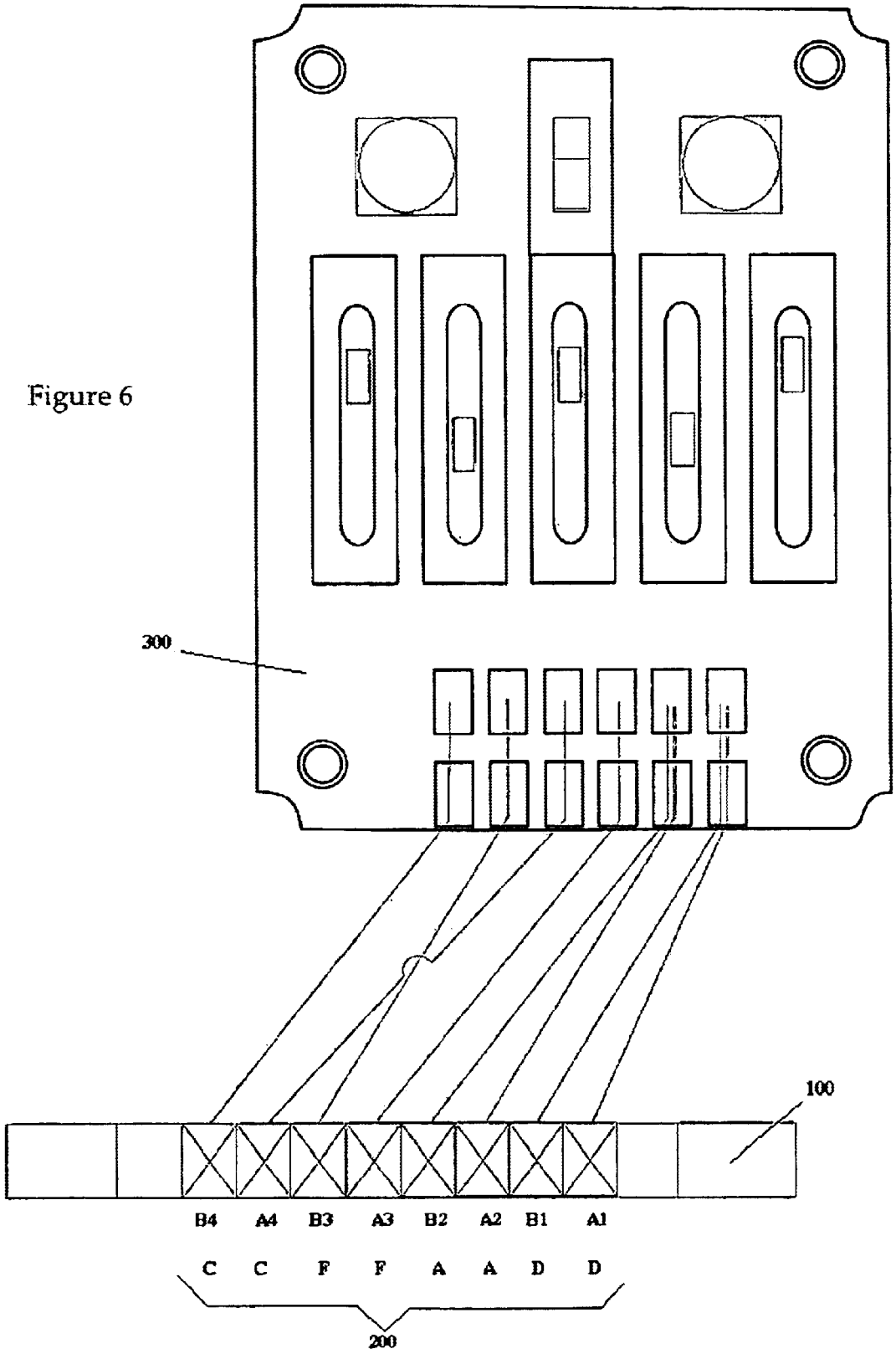
FIG. 6 shows a further exemplary connection scheme of piezoelectric pickups to inputs of the signal processing device, in accordance with the present invention.

The present invention is directed to several aspects of an improved stringed musical instrument, including a novel bridge for piezoelectric (or "piezo") pickups (FIGS. 1A–1D), a piezo pickup comprising a novel coupling configuration (FIGS. 2A–2D) and a novel interface between the piezo pickups and a signal processing device (FIGS. 5 and 6).

Figure 1A:
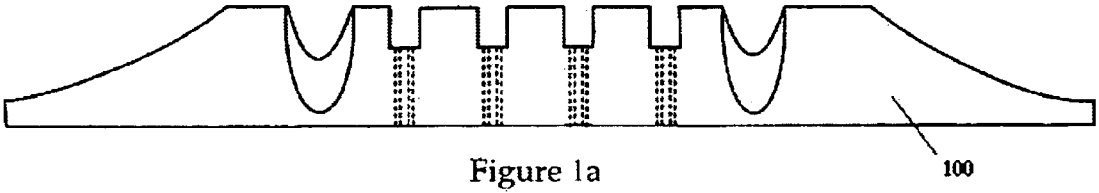
FIGS. 1A through 1D show various views of an exemplary embodiment of a bridge in accordance with the present invention.
Figure 1B:
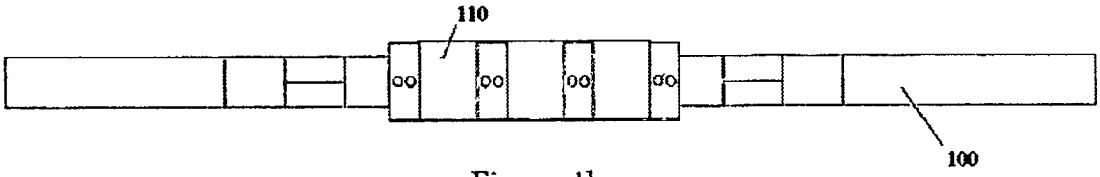

FIG. 1A shows a front view of an exemplary embodiment of 15 a bridge 100 in accordance with the present invention. FIG. 1B shows a top view of the bridge 100. The bridge 100 comprises four slots for mounting four pairs of piezo pickups 200 thereon. The bridge 100 comprises a central portion 110 upon which the piezo pickups 200 are mounted.

Eight thru-holes are provided through the bridge 100 for passing therethrough wires for coupling to the eight piezo pickups 200.

In an exemplary embodiment, the bridge 100 has a length of 160 mm, and a thickness of 8 mm at the ends and 10 mm at 4 the central portion 110, where the piezo pickups are placed. Each of the four slots has a width of 6.15 mm. The central portion 110 of the bridge 100 has a length of 41.66 mm. The diameter of each of the 8 thru-holes is 1.25 mm. Naturally, the actual dimensions can be selected as required.

Figure 1C:
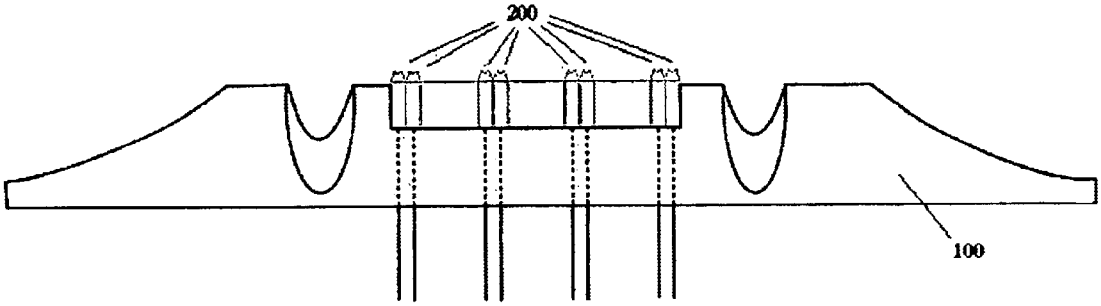
Figure 1D:
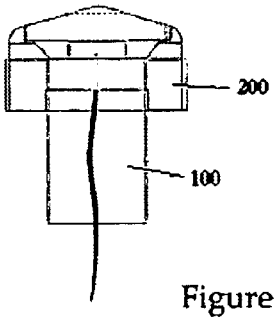

FIG. 1C shows the bridge 100 with the 8 piezo pickups 200 in place FIG. 1D shows a cross-sectional view of the bridge 100 with a piezo pickup in place. A cable coupled to the pickup is also shown.

Figure 2A:
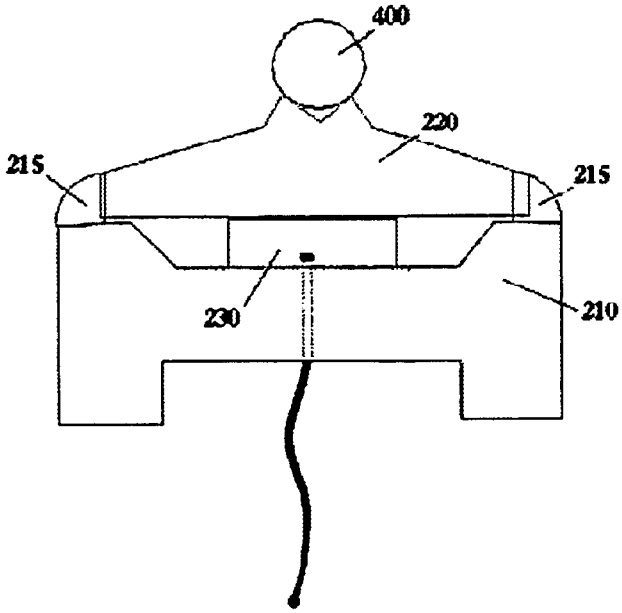
FIGS. 2A and 2B show a conventional piezoelectric pickup.
Figure 2B:
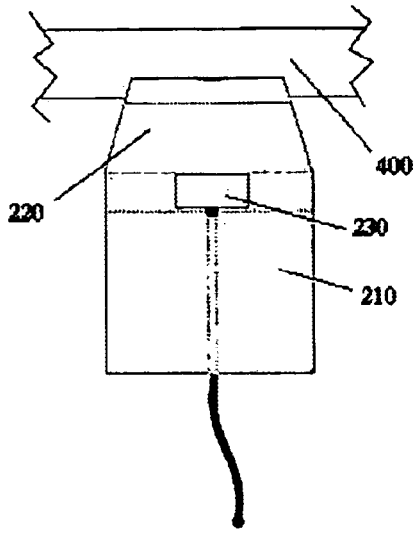

A further aspect of the present invention relates to the piezoelectric pickups 200. FIG. 2A shows a front view of a conventional piezo pickup in its original configuration, and FIG. 2B shows a side view of the same pickup. Each pickup 200 comprises a base 210 and an upper portion 220 which is adapted 15 to contact a string 400. The upper portion 220 is coupled to the base 210 via junctions 215 arranged at opposite ends of the piezo pickup. The junctions 215 allow the upper portion 220 to move relative to the base 210.

The vibrations of the string 400 are transferred by the 20 upper portion 220 to a piezoelectric crystal 230 arranged in the base 210. The piezoelectric crystal 230 generates an electrical signal representative of the string's vibrations.

As seen from above, each piezo pickup 200 has a generally rectangular footprint. With the conventional pickup of FIGS. 2A and 2B, the length of the pickup is generally perpendicular to the string 400.

Figure 2C:
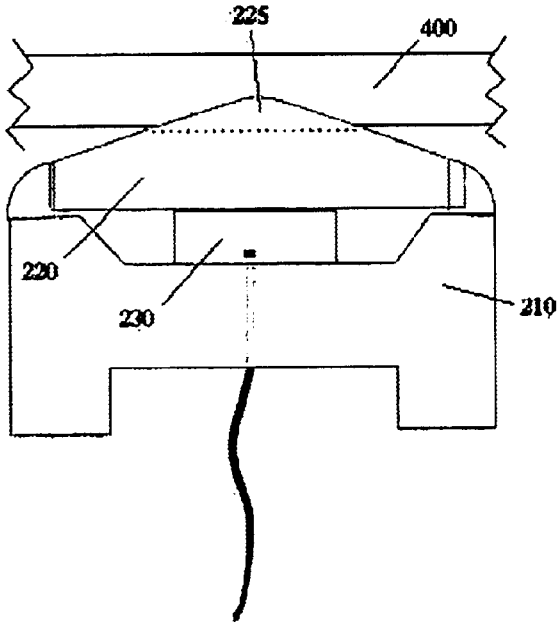
FIGS. 2C and 2D show an exemplary embodiment of a piezoelectric pickup in accordance with the present invention.
Figure 2D:
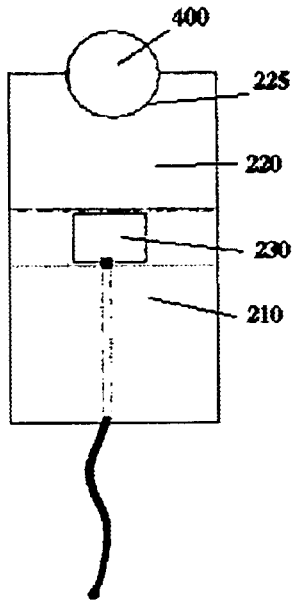

In accordance with the present invention, each piezo pickup 200 is modified by providing a groove 225 along the top surface of the upper portion 220. The groove 225 runs lengthwise, parallel with the length of the pickup 200. The groove 225 receives therein a string 400. This modification allows the pickup 200 to be oriented with its length along the string, thereby allowing the pickups to be placed closely next to each other to accommodate closely spaced strings. In the exemplary embodiment shown, the strings are arranged in pairs. FIG. 2C shows a front view of a piezo pickup 200 as modified in accordance with the present invention. FIG. 2D shows a side view of the modified piezo pickup 200 of the present invention.

In an exemplary embodiment, the groove 225 has a depth of 0.014 mm and a width 0.028 mm and is generally semicircular in cross-section. Naturally, the dimensions and cross-section of the groove 225 can be selected in accordance with the diameter 20 and cross-section of the string 400.

The piezo pickups are coupled to a signal processing device 300, such as the Poly-drive IV, available from RMC Industries. The Poly-drive IV comprises three circuit board assemblies (FIGS. 3A–3D). In accordance with exemplary embodiments of the present invention, the piezo pickups can be coupled to inputs of the signal processing device in two different arrangements as depicted in FIGS. 5 and 6, respectively, so as to produce two distinct types of signals, MIDI signals, and analog signals representative of the actual acoustic sound generated by the instrument. MIDI generated sounds and the acoustic sound can be heard either simultaneously or separate from each other.

Figure 3A:
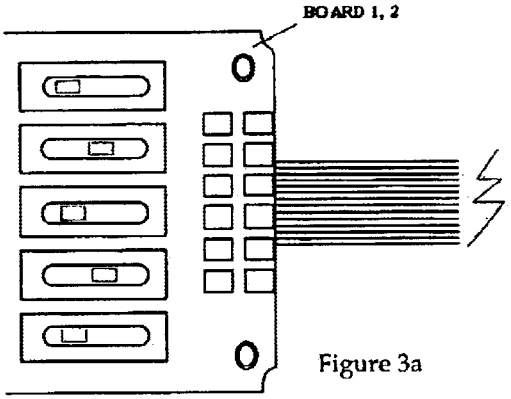
FIGS. 3A through 3D show various components of a commercially available signal processing device for use in the present invention.
Figure 3B:
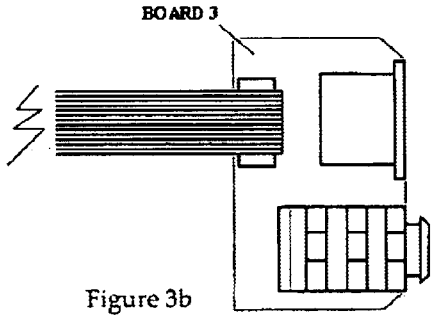
Figure 3C:
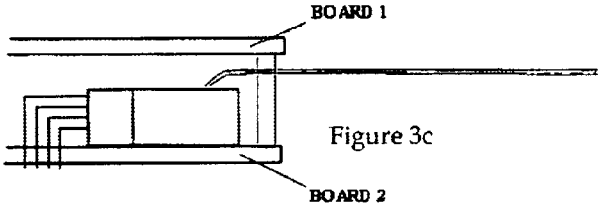

FIGS. 3A–3D show the Polydrive IV system which is composed of two assemblies. As shown in FIG. 3C, the first assembly has two boards, board 1 and board 2, and includes all input connections (shown in FIG. 3A) for the piezo pickups as well as a 13-wire ribbon cable that connects board 2 to a third board, board 3. The signal inputs of the signal processing device are labeled 1–6 and each includes a signal input pad and a ground pad. A signal conductor couples the signal output of each piezo pickup to a signal input pad and a ground conductor couples the ground of each piezo pickup to a ground pad. (See FIGS. 5 and 6, described more fully below.) The signal and ground conductors of each piezo pickup can be arranged in a shielded cable, as shown in the various illustrations.

Figure 3D:
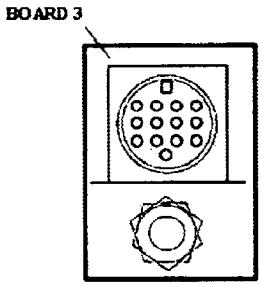

As shown in FIGS. 3B and 3D, the second assembly includes board 3, which comprises a standard 13-pin MIDI jack for coupling to a MIDI interface, and a standard 4 inch jack for coupling to an amplifier.

Figure 4:
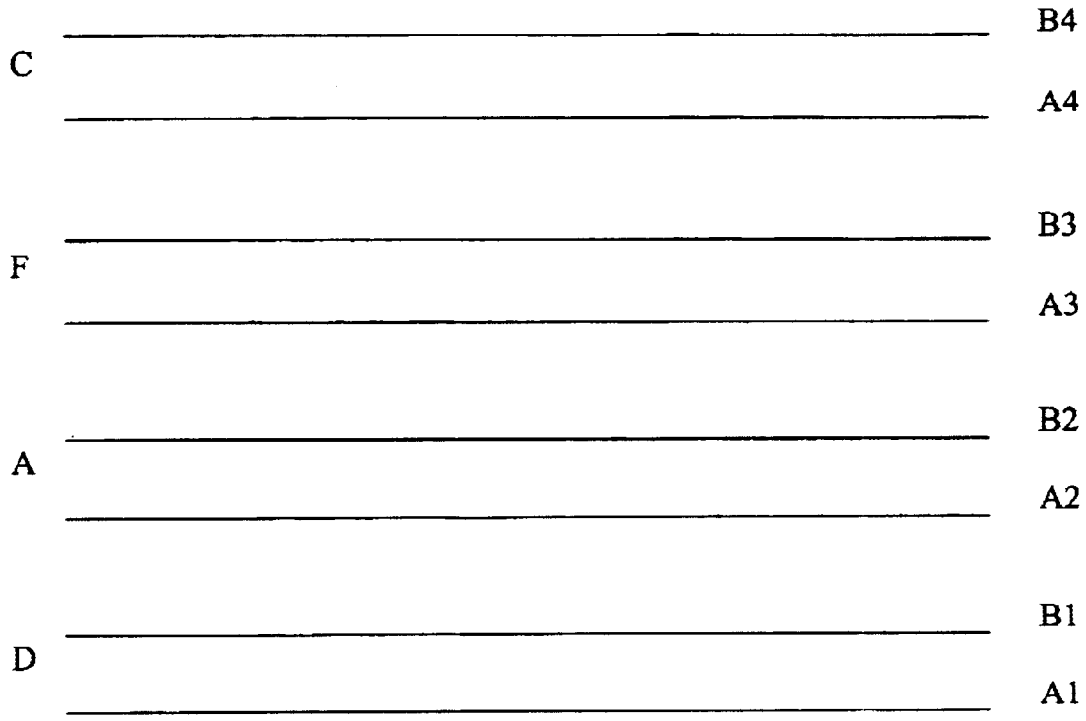
FIG. 4 shows an exemplary grouping of strings.

To more clearly illustrate the connections of the piezo pickups to the Poly-drive IV, the instrument's strings can be divided into two groups, A and B. Group A includes strings A1, A2, A3 and A4 and group B includes strings 91, B2, B3 and B4. As shown in FIG. 4, A1B1, A2B2, A3B3 and A4B4 are representations of the strings D (RE), A (LA), F (FA) and C (DO) respectively; i.e., A1B1 represents the two strings of D 10 (RE), A2B2 represents the two strings of A (LA), etc.

An exemplary connection scheme, referred to as type 1, is illustrated in FIG. 5. The pickups of the strings of groups A, strings A1, A2, A3 and A4, are connected to inputs 1, 2, 3 and 4, respectively, of the signal processing device 300. The 15 pickups of the strings B1 and B2 are connected to input 5 of the signal processing device 300, whereas the pickups of the strings B3 and B4 are connected to input 6. In the embodiments shown inputs 5 and 6 of the signal processing device have been modified to inhibit the production of MIDI sound.

Also shown in FIG. 5 are slide switches on board 1 which control various functions such as Bass, Treble, Mid-Range, Volume and MIDI Volume.

A further exemplary connection scheme type 2, is shown in FIG. 6. The pickups of strings A1 and B1 are connected to input 1 of the signal processing device 300, the pickups of strings A2 and B2 are connected to input 2, the pickup of string A3 is connected to input 3, the pickup of string A4 is connected to input 4; the pickup of string 93 is connected to input 5; and the pickup of string B4 is connected to input 6. For clarity, in FIGS. 5 and 6, the signal and ground conductors of each piezo pickup are shown as one cable. As described above, it is understood that the ground conductors are coupled to the ground pads of the inputs 1–6 and the signal conductors are coupled to the signal input pads of the inputs 1–6. Furthermore, the connections shown in FIGS. 5 and 6 are for the RMC Industries Poly-drive IV. Different connection arrangements may be required for different signal processing devices.

Both connection types 1 and 2 allow the production of MIDI signals and analog signals either simultaneously or separate from each other.

Figure 7A:
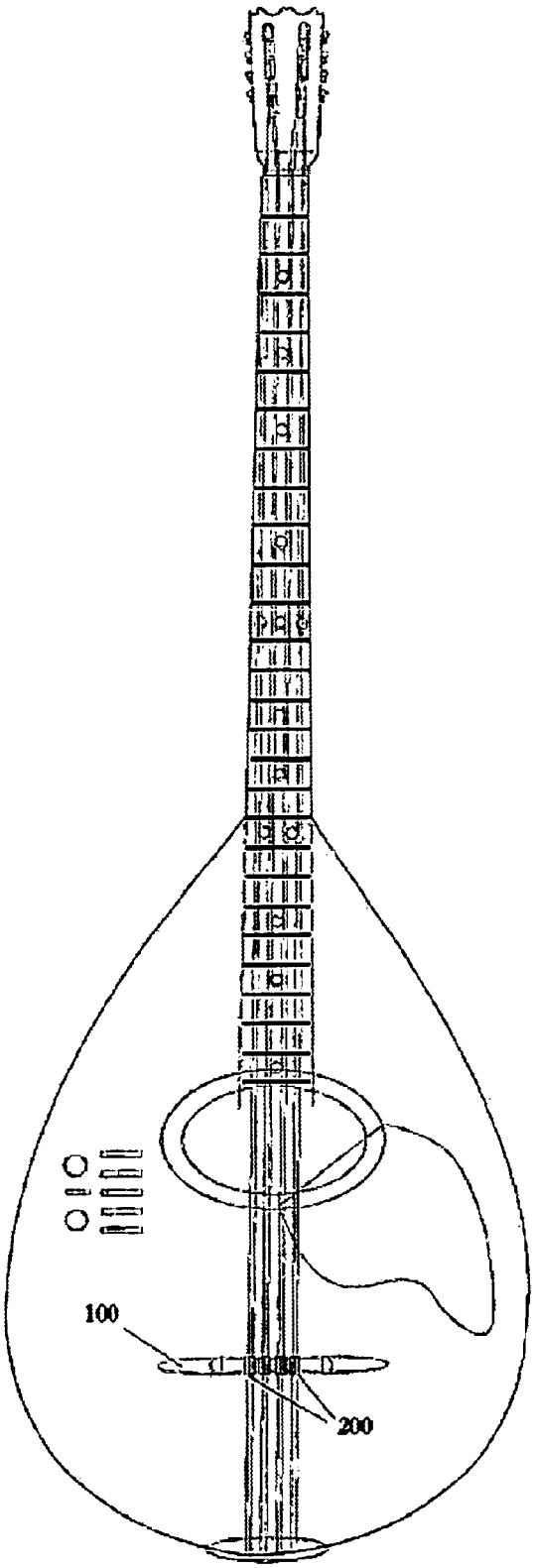
FIGS. 7A and 7B show an exemplary embodiment of a musical instrument in accordance with the present invention.

FIG. 7A shows a top view of an exemplary embodiment of a musical instrument in accordance with the present invention. The instrument of FIG. 7A comprises a bouzouki modified in accordance with the present invention to include exemplary embodiments of the above-described inventive bridge, piezo pickups and signal processing interface.

Figure 7B:
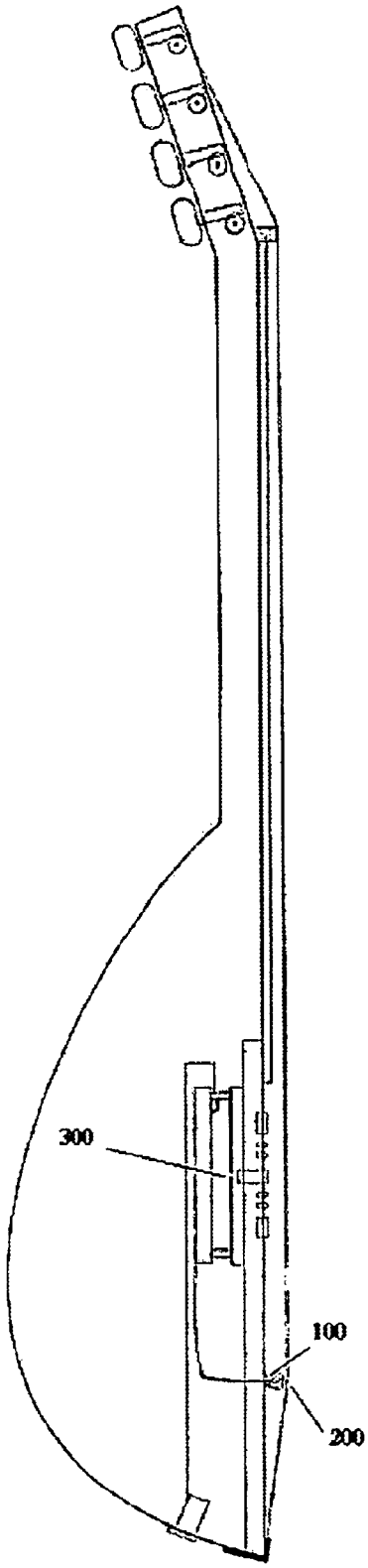

FIG. 7B is a cross-sectional side view of the instrument of FIG. 7A.

As can be understood to a person of ordinary skill in the art, the present invention is not limited to the exemplary embodiment illustrated.

What is claimed is:

1. A pickup device for a string of a double stringed musical instrument having a plurality of strings arranged in pairs, the pickup device comprising:

an upper portion, the upper portion contacting one of the plurality of strings and including a groove for receiving therein the one of the plurality of strings; and a base portion, the upper portion being arranged on top of the base portion, wherein the pickup device has a length and a width, the length being greater than the width, and the groove has an axis which is substantially parallel with the length of the pickup device.

2. The pickup device of claim 1, wherein the base portion includes a piezoelectric element for generating an electrical signal in accordance with vibration of the one of the plurality of strings.

3. The pickup device of claim 1, wherein the groove has a semicircular cross-section.

4. A pickup device for a string of a double stringed musical instrument having a plurality of strings arranged in pairs, the pickup device comprising:

an upper portion, the upper portion contacting one of the plurality of strings and including a groove for receiving therein the one of the plurality of strings; and a base portion, the upper portion being arranged on top of the base portion and being coupled to the base portion via junctions arranged on opposite ends of the pickup device, wherein the groove has an axis which is substantially parallel with a line extending between the junctions.

5. A doubled stringed musical instrument comprising:

a plurality of strings;

a pickup device for each of the plurality of strings, each pickup device contacting its respective string; and a signal processing device, the signal processing device being coupled to the pickups, wherein the plurality of strings are arranged in pairs so that strings of a pair are closer to each other than to strings of another pair, and the signal processing device includes a musical instrument digital interface (MIDI).

6. The double stringed musical instrument of claim 5, wherein the signal processing device includes an analog signal interface.

7. The double stringed musical instrument of claim 5, wherein the signal processing device includes a further plurality of signal inputs, wherein the further plurality of signal inputs is less than the plurality of strings.

8. The double stringed musical instrument of claim 7, wherein the plurality of strings includes eight strings and the further plurality of signal inputs includes six signal inputs.

9. The double stringed musical instrument of claim 5, wherein the signal processing device includes a further plurality of signal inputs and wherein each signal input is coupled to at least one pickup.

10. The pickup device of claim 4, wherein the base portion includes a piezoelectric element for generating an electrical signal in accordance with vibrations of the one of the plurality of strings.

11. A double stringed musical instrument comprising the pickup device of claim 1.

12. A double stringed musical instrument comprising the pickup device of claim 4.

* * * * *